US006781554B2

(12) United States Patent
Lee et al.

(10) Patent No.: US 6,781,554 B2
(45) Date of Patent: Aug. 24, 2004

(54) COMPACT WIDE SCAN PERIODICALLY LOADED EDGE SLOT WAVEGUIDE ARRAY

(75) Inventors: Kuan M. Lee, Brea, CA (US); Reinhardt W. Krueger, Anaheim, CA (US); Fangchou Yang, Los Angeles, CA (US)

(73) Assignee: Raytheon Company, Waltham, MA (US)

( * ) Notice: Subject to any disclaimer, the term of this patent is extended or adjusted under 35 U.S.C. 154(b) by 78 days.

(21) Appl. No.: 10/218,792

(22) Filed: Aug. 14, 2002

(65) Prior Publication Data

US 2004/0032374 A1 Feb. 19, 2004

(51) Int. Cl.[7] ..... H01Q 13/10
(52) U.S. Cl. ..... 343/771; 343/768; 343/770
(58) Field of Search ..... 343/768, 770, 343/771, 767; 333/21 A, 21 R

(56) References Cited

U.S. PATENT DOCUMENTS

| | | | | |
|---|---|---|---|---|
| 3,594,806 A | * | 7/1971 | Black et al. | 343/771 |
| 4,301,430 A | * | 11/1981 | Stachejko | 333/24.1 |
| 4,851,857 A | * | 7/1989 | Dienes | 343/771 |
| 5,079,561 A | | 1/1992 | Park | |
| 5,289,200 A | | 2/1994 | Kelly | |
| 5,541,612 A | * | 7/1996 | Josefsson | 343/771 |
| 5,557,291 A | | 9/1996 | Chu et al. | |
| 5,579,019 A | | 11/1996 | Uematsu et al. | |
| 5,619,216 A | | 4/1997 | Park | |
| 5,638,079 A | | 6/1997 | Kastner et al. | |
| 6,304,228 B1 | | 10/2001 | Smith et al. | |

OTHER PUBLICATIONS

"Antenna Engineering Handbook," Edited by H. Jasik, Chapter 9, Slot–Antenna Arrays, written by M.J. Ehrlich, pp. 9–1 to 9–18, 1961 by McGraw–Hill Book Company.

"An Edge–Slotted Waveguide Array with Dueal–Plane Monopulse," by Richard R. Kinsey, IEEE Transactions on Antennas and Propagation, vol. 47, No. 3, Mar. 1999, pp. 474–481.

* cited by examiner

*Primary Examiner*—Tho Phan
(74) *Attorney, Agent, or Firm*—Leonard A. Alkov

(57) ABSTRACT

A unit element of a periodically loaded edge slot array includes a reduced-height waveguide section having top and bottom walls and opposed first and second sidewalls defining a waveguide space. A slot is formed in the first side wall at an angle with respect to a waveguide longitudinal axis. At least one conductive post protrudes from the top wall into the waveguide space. The unit element can be incorporated into sticks of an electronically scanned antenna.

21 Claims, 5 Drawing Sheets

COMPACT WIDE SCAN PERIODICALLY LOADED EDGE SLOT WAVEGUIDE ARRAY

BACKGROUND OF THE DISCLOSURE

The conventional approach to increase the scan angle of an edge slot array is to use a serpentine type waveguide array. However, the serpentine type of waveguide array uses considerable space for the serpentine. Another approach is to use dielectric loading in the waveguide, which not only increases the array weight but also increases the insertion loss significantly. A longitudinal slot in the broad wall has been used but the broad wall design restricts the scan range (in the plane orthogonal to the waveguide axis).

SUMMARY OF THE DISCLOSURE

A unit element of a periodically loaded edge slot array includes a reduced-height waveguide section having top and bottom walls and opposed first and second sidewalls defining a waveguide space. A slot is formed in the first side wall at an angle with respect to a waveguide longitudinal axis. At least one conductive post protrudes from the top wall into the waveguide space. The unit element can be incorporated into sticks of an electronically scanned antenna.

BRIEF DESCRIPTION OF THE DRAWING

These and other features and advantages of the present invention will become more apparent from the following detailed description of an exemplary embodiment thereof, as illustrated in the accompanying drawings, in which.

DETAILED DESCRIPTION OF THE DISCLOSURE

In order to achieve a larger scan range in the elevation plane and to obtain an extended frequency scan in the azimuth plane for a monopulse antenna, a periodically loaded edge slot array is needed. For an exemplary application for this invention, an edge slot array with half-height waveguide is desirable. A periodically loaded edge slot design with half-height waveguide using a different loading approach in accordance with aspects of this invention can meet this need.

Figure 1A:
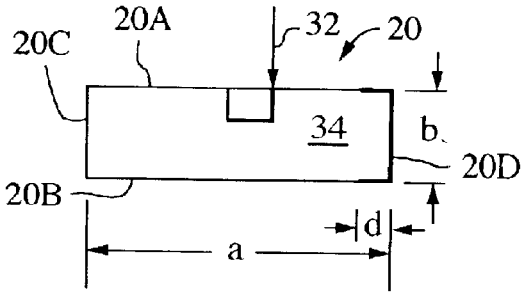
FIG. 1A is an end view of an exemplary embodiment of a unit element of a periodically loaded edge slot array in accordance with aspects of the invention.
Figure 1B:
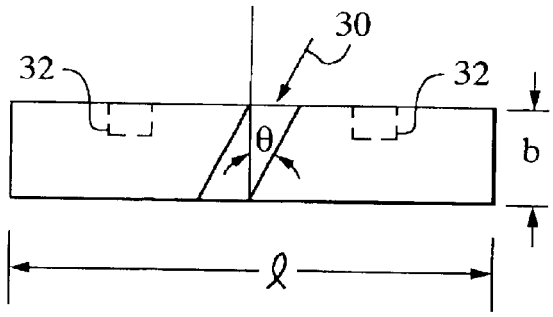
FIG. 1B is a front view of the unit element of FIG. 1A.

FIGS. 1A and 1B illustrate an exemplary embodiment of a unit element of a periodically loaded edge slot array in accordance with aspects of the invention. The effective electrical length of the unit element is selected based on the desirable scan range and frequency band of interest. It is also typically selected so that the grating lobes do not show up in the region of interest. For example, an electrical length between half wavelength and full wavelength in the periodically loaded waveguide (at the center frequency) can be used to cover a scan range of about 20 degrees. The unit element 20 comprises a section of half-height waveguide comprising top and bottom walls 20A, 20B, connected by sidewalls 20C, 20D. An edge slot 30 is formed in side wall 20D of the waveguide, at an angle of theta degrees from vertical, in this exemplary embodiment. Typical theta angles are given in FIG. 4. The slot angles are selected to provide an aperture distribution for the antenna to achieve a low side lobe pattern. The edge slot is cut to a distance d (FIG. 1A) into the top and the bottom walls of the waveguide. The slot depth is a design parameter to obtain an optimized coupling curve. To obtain a good radiation efficiency, i.e. to provide a resonant slot, in a preferred embodiment, the overall perimeter length of the edge slot is chosen to be approximately equal to the mid-frequency wavelength. The slot extends or is cut into the top and bottom walls by the distance d to achieve this perimeter length.

The width of the slot is related to the bandwidth performance. The slot width is selected to be 0.125 inch in an exemplary X-band design to achieve a wideband performance.

The unit element 20 is periodically loaded with a series of metal posts 32, protruding downwardly from the top wall 20A of the waveguide into the waveguide space 34.

Figure 2:
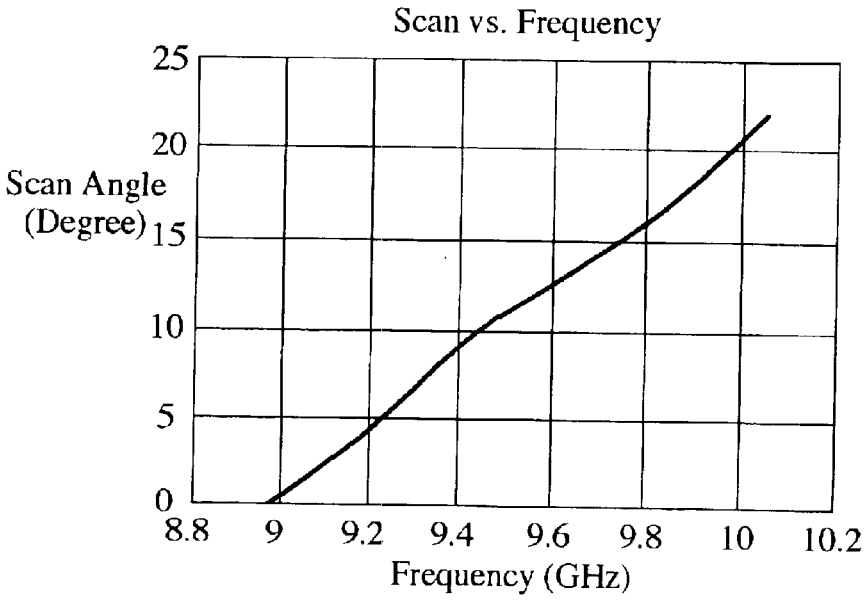
FIG. 2 is a graph of the scan angle versus frequency of an embodiment of an array employing the invention.

The scan performance of a periodically loaded half height waveguide as shown in FIGS. 1A–1B is shown in FIG. 2. For this embodiment, the waveguide 20 has a width dimension "a" of 0.58 inch, and a height dimension "b" of 0.20 inch (see FIG. 1A). This compares with a standard X-Band waveguide with a width dimension "a" of 0.90 inch and a height dimension "b" of 0.40 inch. A half height of b=0.2 inches for X-band operation allows the antenna to achieve a dual plane monopulse capability while maintaining a similar aperture size and antenna pattern performance, in an exemplary embodiment. The cut-off frequency for 0.58 inch wide waveguide is about 10.17 GHz without tuning elements. The "unit element" spacing between each slot radiator for this embodiment is chosen to be 0.88 inch. In each 0.88 inch section, the waveguide 20 is loaded with two metal buttons 32 of size 0.15 inch (height)×0.1 inch (diameter), allowing evanescent mode operation below the cutoff of the unloaded waveguide. The size of the posts 32 is selected for a given application to provide the desired frequency band and scan performance. With a spacing of 0.44 inch between the two buttons, the pass band for this waveguide slot array is approximately from about 8.0 GHz to 10.5 GHz. The scan range achieved by this exemplary embodiment is from 0 to about 20 degrees from 9.0 GHz to 10.0 GHz, a relatively large scan range for this frequency range. The design is very compact compared with the conventional serpentine design. It can be combined with a monopulse approach, discussed more fully below, to enhance the antenna performance.

Figure 3:
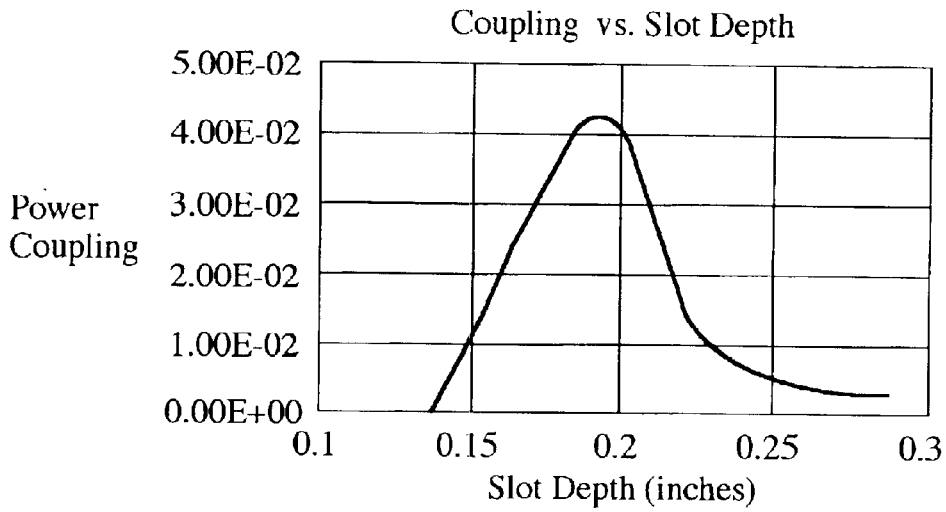
FIG. 3 shows the slot coupling of an analytic model of a periodically loaded slot edge array as a function of slot depth.
Figure 4:
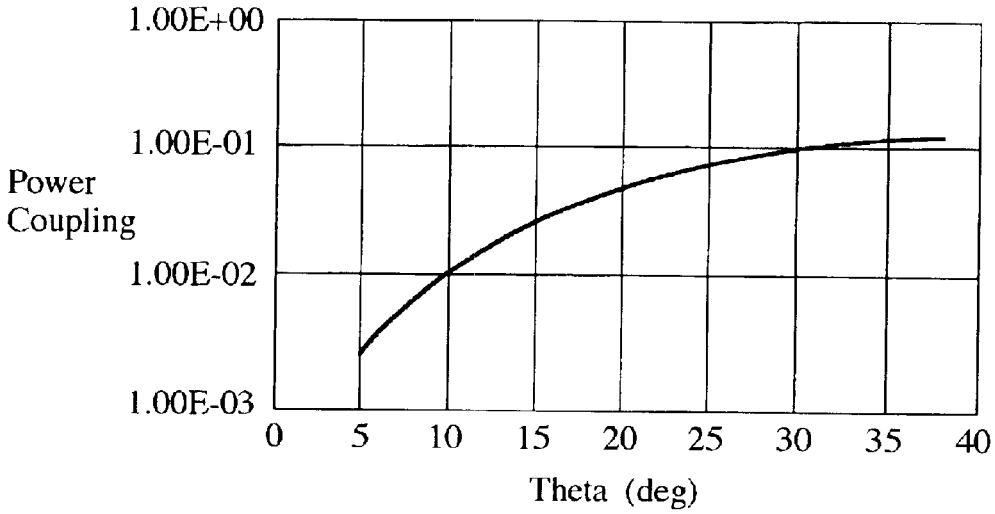
FIG. 4 shows the coupling of the analytic model as a function of slot angle.
Figure 5:
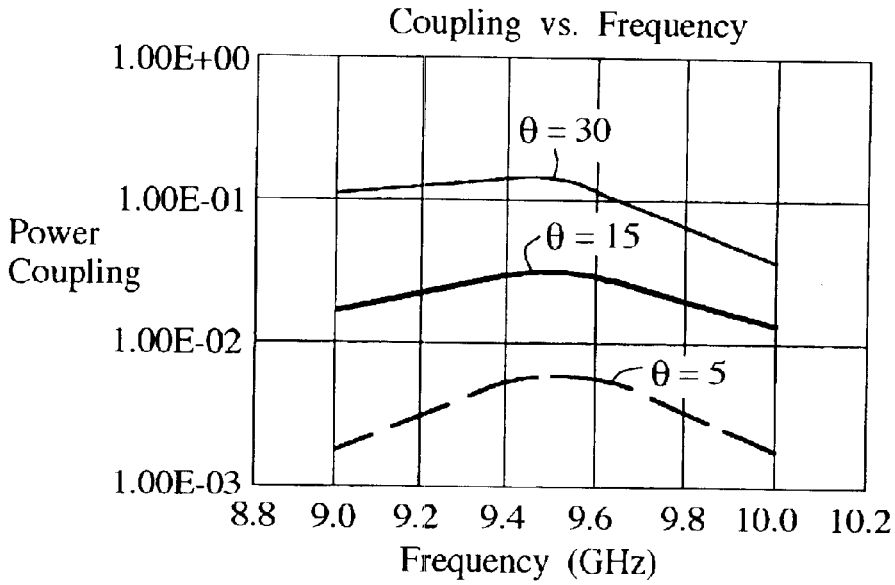
FIG. 5 shows the coupling of the analytic model as a function of frequency.

An analytical model of the half-height periodically loaded edge slot array has been developed based on a three dimensional HFSS (High Frequency Structure Simulation) model to study the coupling characteristics of the periodically loaded slot waveguide. FIG. 3 shows the slot coupling as a function of slot depth. FIG. 4 shows the coupling as a function of slot angle. FIG. 5 shows the coupling as a function of frequency for three different slot angles. The model indicates that the slot element has a large coupling range. The particular unit element modeled can be used in a 9 to 10 Ghz frequency band to provide a scan range of 20 degrees. The periodically loaded slot waveguide can be used in a very tight element spacing. For one exemplary embodiment, an element spacing of 0.3325 inch by 0.88 inch was employed, where 0.3325 inch is the spacing between the waveguide center-to-center separation and 0.88 inch is the spacing between the slot-to-slot separation.

It is a challenging problem to obtain dual-plane monopulse, i.e., monopulse patterns in both azimuth and elevation planes, for a slot waveguide array. Conventionally, the traveling wave array is fed by a center-fed series network or an end-fed ladder network to achieve sum and difference distributions. However, it is difficult to apply this technique to the edge-slotted waveguide array. In the monopulse approach described in "An Edge-slotted Waveguide Array with Dual-plane Monopulse", by Richard R. Kinsey, IEEE Transactions on Antennas and Propagation, Vol. 47, No.3, March 1999, pages 474–481, the monopulse stick phased array aperture is formed by interleaving two arrays of sticks, with each stick an end-fed, edge-slotted traveling wave type waveguide array. The design principle of the traveling wave array is well known in the art, for example, "Antenna Engineering Handbook" Edited by H Jasik, Chapter 9, Slot Antenna Arrays, written by M. J. Ehrlich, pages 9–1 to 9–18,1961 by McGraw-Hill Book Company. Half-height waveguide array elements are used for tight element spacing. The periodically loaded edge slot element 20 can be used in the dual plane monopulse approach to extend the frequency scan.

Figure 6:
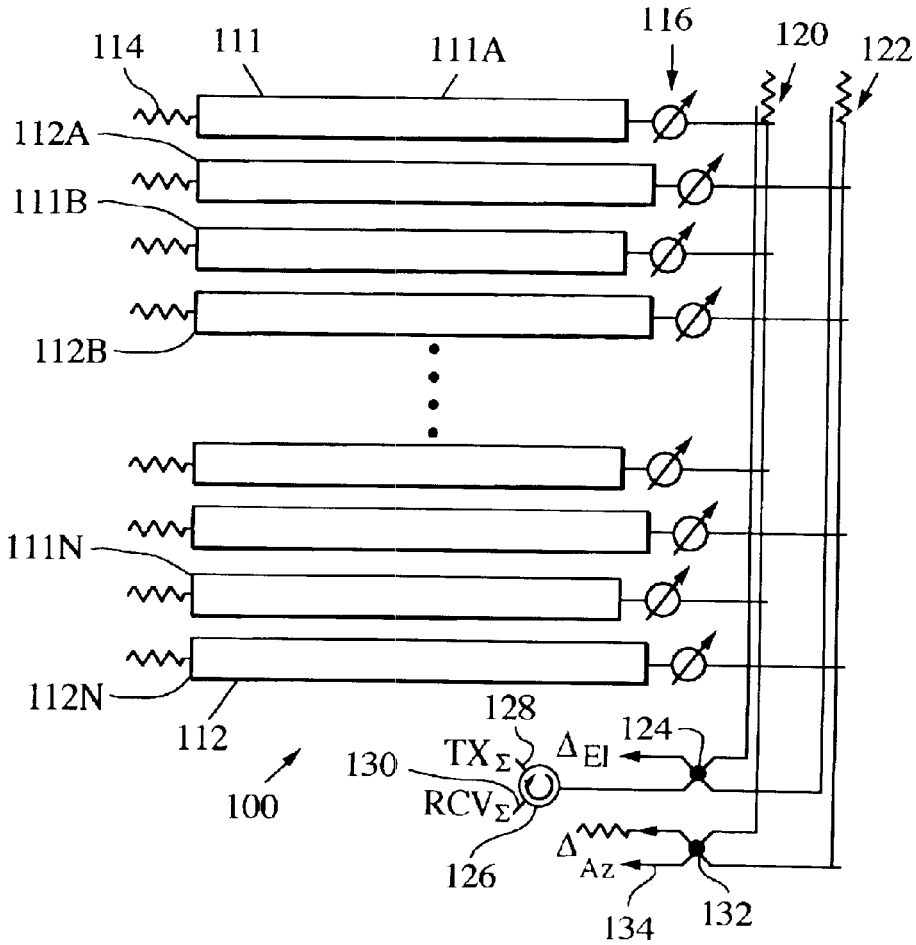
FIG. 6 shows a block diagram of an embodiment of an electronically scanned array (ESA) with monopulse capability and with extended frequency scan using a periodically loaded edge slot array in accordance with aspects of the invention.

FIG. 6 shows a block diagram of an embodiment of an electronically scanned array (ESA) 100 with monopulse capability and with extended frequency scan using a periodically loaded edge slot array in accordance with aspects of the invention. The system 100 includes two interleaved arrays 111, 112 of radiator sticks. Array 111, the "odd" array, has sticks 111A, 111B, . . . 111N. Array 112, the "even" array, has sticks 112A, 112B, . . . 112N. The sticks of the two arrays are interleaved such that the stick order in this embodiment is 111A, 112A, 111B, 112B, . . . 111N, 112N, as shown in FIG. 6. Each stick is a periodically loaded edge slot waveguide element comprising unit elements 20 as shown in FIGS. 1A–1B. One end of the waveguide element is terminated in a load 114. The other end of the waveguide element is coupled to row beamforming networks 120,122 through a phase shifter 116.

The excitations for the two arrays 111, 112 are each derived from "even" and "odd" aperture distributions obtained by summing and subtracting the Taylor and Bayliss distributions, respectively, as described in "An Edge-slotted Waveguide Array with Dual-plane Monopulse," cited above. Combining each pair of neighboring sticks (even and odd) for the two arrays in 3-dB hybrids 132 and 124 recovers the Taylor and Bayliss distributions. Monopulse in the plane orthogonal to the stick is obtained in the conventional manner by combining the individual linear array outputs in beamforming networks 120 and 122 that forms independent sum and difference patterns. Thus, ports of networks 120 and 122 are connected to sidearm ports of hybrid network 124. The difference port of the hybrid network develops the difference elevation (ΔEI) pattern, and the sum port is coupled to a circulator 126 to provide a means to connect a transmit sum signal ($TX_\Sigma$) at port 128 and obtain a receive sum signal ($RX_\Sigma$) at port 130. Ports of networks 120 and 122 are also connected to hybrid network 132 to develop at its difference port 134 the difference azimuth signal (ΔAz), as described in "An Edge-slotted Waveguide Array with Dual-plane Monopulse," cited above. The RF power can be doubled by coupling the output power to both even and odd array components through the above-described feed networks. The power is doubled by distributing energy into both the even and odd arrays.

Figure 7A:
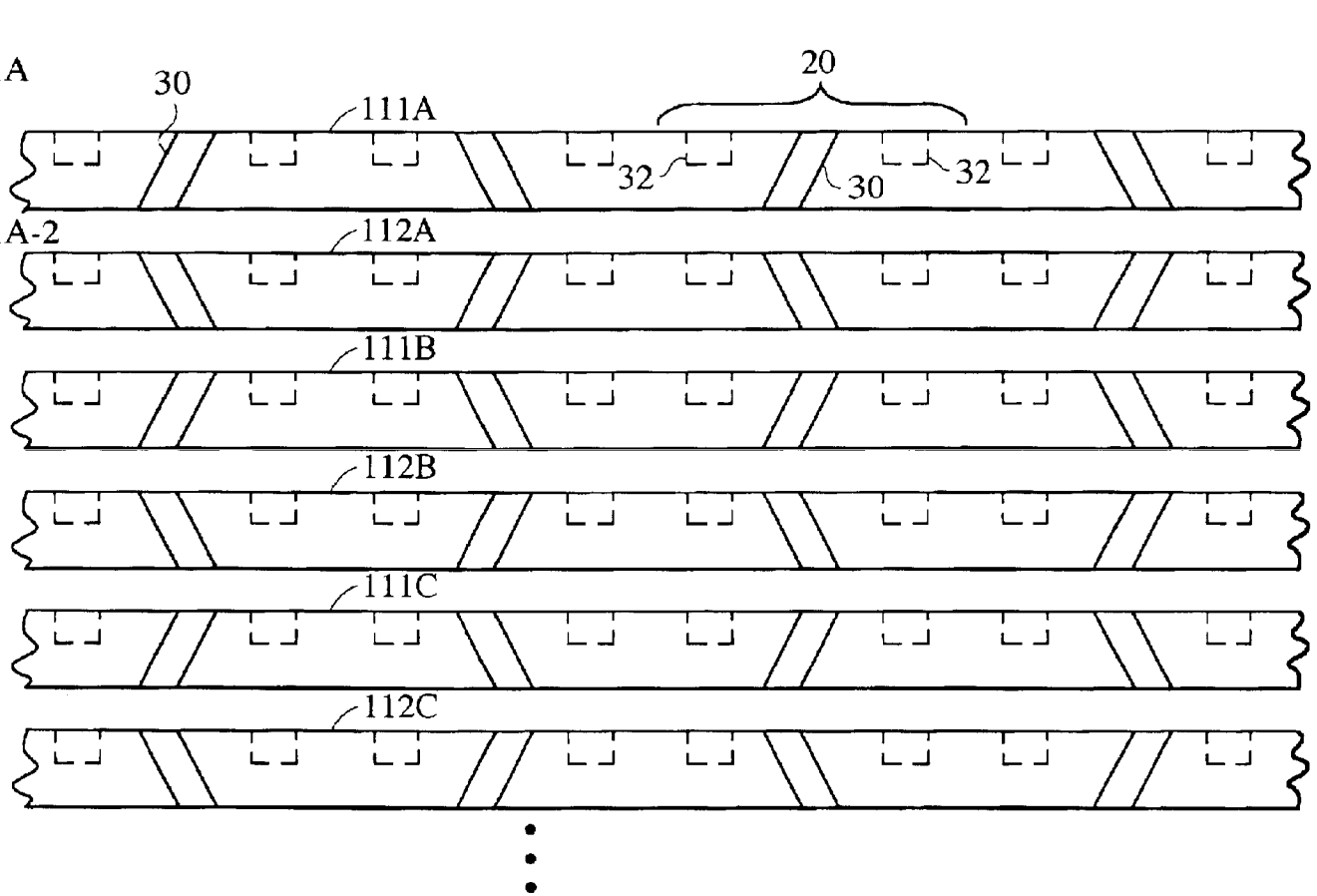
FIG. 7A is a diagrammatic front view of a portion of the radiating face of the array comprising the system of FIG. 6.
Figure 7B:
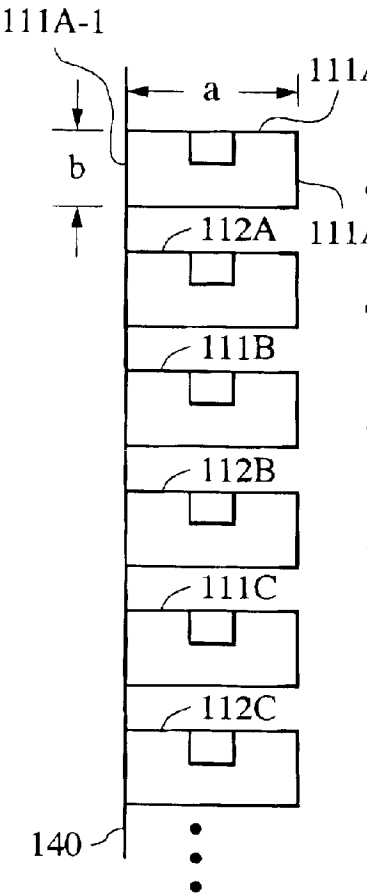
FIG. 7B is a diagrammatic end view of the portion of the array of FIG. 7A.

FIGS. 7A and 7B illustrate the array elements in further detail. FIG. 7A is a diagrammatic front view of a portion of the radiating face of the array. FIG. 7B is a diagrammatic side view of the array portion shown in FIG. 7A. As indicated in FIG. 7A with respect to exemplary stick 111A, each stick includes a plurality of unit elements 20, each unit element with a set of posts 32 and a radiating slot 30. FIG. 7B shows a ground plane 140 running along one sidewall of each stick, opposite the sidewall which comprises the radiating slot edge. For fine tuning purposes, the ground plane 140 can sometimes also be adjusted to be above the sidewall 111A-1. For exemplary stick 111A, the ground wall runs along, and can in some applications form, the side wall 111A-1, and the opposite side wall 111A-2 is the radiating edge with the slots 30 formed therein.

Figure 8:
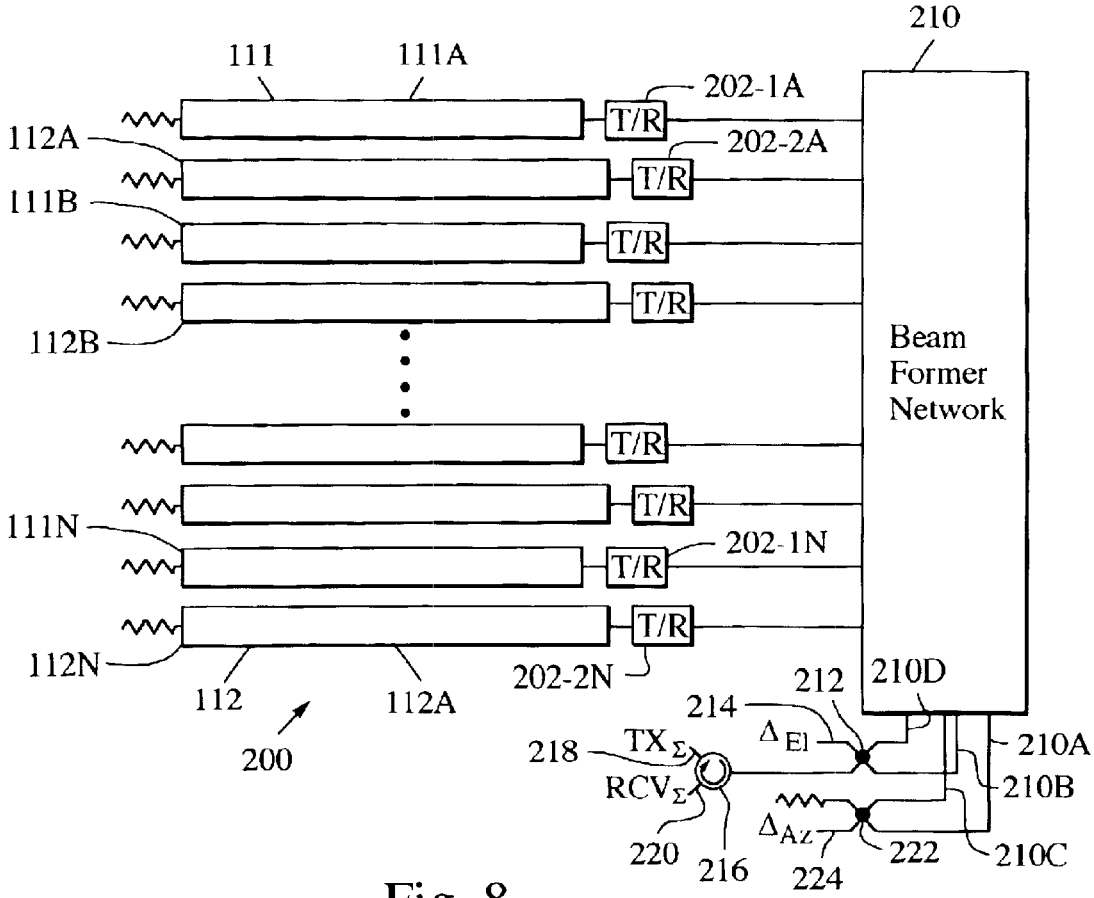
FIG. 8 is a schematic diagram of an exemplary embodiment of a low cost active ESA antenna with extended frequency scan capability using a periodically loaded edge slot element in accordance with aspects of the invention, employing one T/R module per stick.

To improve the antenna efficiency, transmit/receive (T/R) modules can be incorporated in a further embodiment of the antenna. FIG. 8 is a schematic diagram of an exemplary embodiment of a low cost active ESA (AESA) antenna 200 with extended frequency scan capability using a periodically loaded edge slot element in accordance with aspects of the invention. As with the system 100 of FIG. 6, the antenna includes interleaved odd and even arrays 111 and 112 of sticks 111A–111N and 112A–112N. To reduce the cost of the antenna, one T/R module per stick can be used. Thus, T/R modules 202-1A to 202-2N are employed, with module 202-1A connected to the I/O port of stick 111A, module 202-2A connected to the I/O port of stick 112A, and so on.

The T/R modules 202-1A to 202-2N are connected to a beam former network 210, which has 2N I/O ports for connecting to the T/R modules, and four I/O ports 210A–210D for developing the sum and difference pattern signals. Thus, ports 210A and 210C are connected to sidearms of 3 dB hybrid network 222, which develops at difference port 224 the difference azimuth signal ($\Delta_{Az}$). I/O ports 210B and 210D are connected to sidearm ports of 3 dB hybrid network 212, which develops at its difference port 214 the difference elevation signal ($\Delta_{El}$). The hybrid sum port is connected to a circulator 216, with one port receiving the sum receive signal (RCV) and the other port for connection to a transmitter to input the transmit signal (TX). The structure of the beam former network 210 is essentially the same as the beam former network shown in FIG. 6, with the phase shifters 116 in FIG. 6 replaced by the T/R modules 201-1A through 202-2N in FIG. 8.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A unit element of a periodically loaded edge slot array, comprising:

a reduced-height, reduced width waveguide section having top and bottom walls and opposed first and second side walls defining a waveguide space;

a slot formed in said first side wall at an angle with respect to a waveguide longitudinal axis; and at least one conductive post protruding from said top wall into the waveguide space;

wherein the slot array has an operating frequency pass band bounded by a low frequency and a high frequency, and wherein the low frequency is below a cutoff frequency for the reduced height, reduced width waveguide section in the absence of the at least one conductive post, the waveguide section adapted for evanescent mode operation in the pass band below said cutoff frequency.

2. The element of claim 1, wherein said at least one conductive post consists of first and second posts positioned along the longitudinal axis to straddle the slot.

3. The element of claim 1 wherein said slot has a slot axis which defines an acute angle with a plane of the top wall.

4. The element of claim 3 wherein said acute angle is in the range of 0 to 35 degrees.

5. The element of claim 1, wherein the pass band is an X-band frequency band, and the waveguide section has a height of about 0.20 inch and a width of about 0.58 inch.

6. An electronically scanned antenna (ESA) comprising two interleaved arrays of radiating sticks, each stick having an end-fed, edge-slotted traveling wave type waveguide structure comprising a plurality of unit elements as recited in claim 1.

7. An active electronically scanned antenna (AESA) comprising two interleaved arrays of radiating sticks, each stick an end-fed, edge-slotted traveling wave waveguide structure comprising a plurality of unit elements as recited in claim 1, and a plurality of transmit/receive (T/R) modules.

8. A periodically loaded edge slot array, comprising:

an array of reduced-height waveguides, wherein each of said reduced-height waveguides has a reduced width;

each waveguide having top and bottom walls and opposed first and second side walls defining a waveguide space, a plurality of periodically spaced slots formed in said first side wall at an angle with respect to a waveguide longitudinal axis, and a plurality of periodically spaced conductive posts protruding from said top wall into the waveguide space between each slot;

wherein the antenna has an operating frequency pass band bounded by a low frequency and a high frequency, and wherein the low frequency is below a cutoff frequency for the reduced height, reduced width waveguides in the absence of the at least one conductive post, the waveguide adapted for evanescent mode operation in the pass band below said cutoff frequency.

9. The array of claim 8, wherein each of said plurality of conductive posts are positioned along the longitudinal axis.

10. The array of claim 8 wherein said plurality of slots each has a slot axis which defines an acute angle with a plane of the top wall.

11. The array of claim 10 wherein said acute angle is in the range of 0 to 35 degrees.

12. The array of claim 8, further including a feed system for end feeding each waveguide with excitation signals.

13. The array of claim 8, wherein the pass band is an X-band frequency band, and the waveguide section has a height of about 0.20 inch and a width of about 0.58 inch.

14. An active electronically scanned antenna (AESA) comprising:

first and second interleaved arrays of radiating sticks, each stick having an end-fed, edge-slotted traveling wave type waveguide structure;

each stick comprising a plurality of unit elements, each unit element including a reduced-height waveguide section having top and bottom walls and opposed first and second side walls defining a waveguide space;

a slot formed in said first side wall at an angle with respect to a waveguide longitudinal axis; and at least one conductive post protruding from said top wall into the waveguide space;

first and second beam forming networks coupled respectively to the first and second interleaved arrays of radiating sticks for forming sum and difference pattern signals.

15. The antenna of claim 14, further comprising:

a plurality of transmit/receive (T/R) modules, each module coupled between one of said first and second beam forming networks and a corresponding radiating stick to provide excitation signals to said corresponding stick during a transmit mode and to amplify signals received during a receive mode.

16. The antenna of claim 14, wherein said at least one conductive post, for each unit element, includes first and second posts positioned along the longitudinal axis to straddle the slot.

17. The antenna of claim 14, wherein said slot for each unit element has a slot axis which defines an acute angle with a plane of the top wall.

18. The antenna of claim 17, wherein said acute angle is in the range of 0 to 35 degrees.

19. The antenna of claim 14, wherein each of said reduced-height waveguide sections has a reduced width.

20. The antenna of claim 19, wherein the antenna has an operating frequency pass band bounded by a low frequency and a high frequency, and wherein the low frequency is below a cutoff frequency for the reduced height, reduced width waveguides in the absence of the at least one conductive post, the waveguide adapted for evanescent mode operation in the pass band below said cutoff frequency.

21. The antenna of claim 20, wherein the pass band is an X-band frequency band, and the waveguide section has a height of about 0.20 inch and a width of about 0.58 inch.

* * * * *